United States Patent [19]

Norris

[11] Patent Number: 4,898,086

[45] Date of Patent: Feb. 6, 1990

[54] LIVING SPACE VENTILATION

[76] Inventor: Alan H. Norris, 120 Saddle Mountain Rd., Rome, Ga. 30161

[21] Appl. No.: 215,404

[22] Filed: Jul. 5, 1988

[51] Int. Cl.[4] ..... F24F 11/00

[52] U.S. Cl. ..... 98/33.1; 98/42.04

[58] Field of Search ..... 98/33.1, 39.1, 42.04, 98/900; 49/25, 31

[56] References Cited

U.S. PATENT DOCUMENTS

| | | | |
|---|---|---|---|
| 2,104,088 | 1/1938 | Lyman | 98/900 X |
| 3,235,247 | 2/1966 | Tolson | 49/31 X |
| 3,337,992 | 8/1967 | Tolson | 49/25 |
| 4,099,047 | 7/1978 | Kirkland, Jr. | 98/42.04 X |
| 4,105,015 | 8/1978 | Isom | 98/42.04 X |
| 4,251,026 | 2/1981 | Siegel et al. | 98/42.04 X |

FOREIGN PATENT DOCUMENTS

| | | | |
|---|---|---|---|
| 2492062 | 4/1982 | France | 98/42.04 |
| 130741 | 6/1986 | Japan | 98/900 |
| 17545 | 1/1987 | Japan | 98/900 |

*Primary Examiner*—Harold Joyce

[57] ABSTRACT

At dawn the outside air is coolest over the 24 hour daily cycle. A photo electric device actuates a fan just after dawn to ventilate the house and is later switched off by a time delay device. Existing fans may be used.

5 Claims, 1 Drawing Sheet

LIVING SPACE VENTILATION

BRIEF SUMMARY OF THE INVENTION

Figure 1:
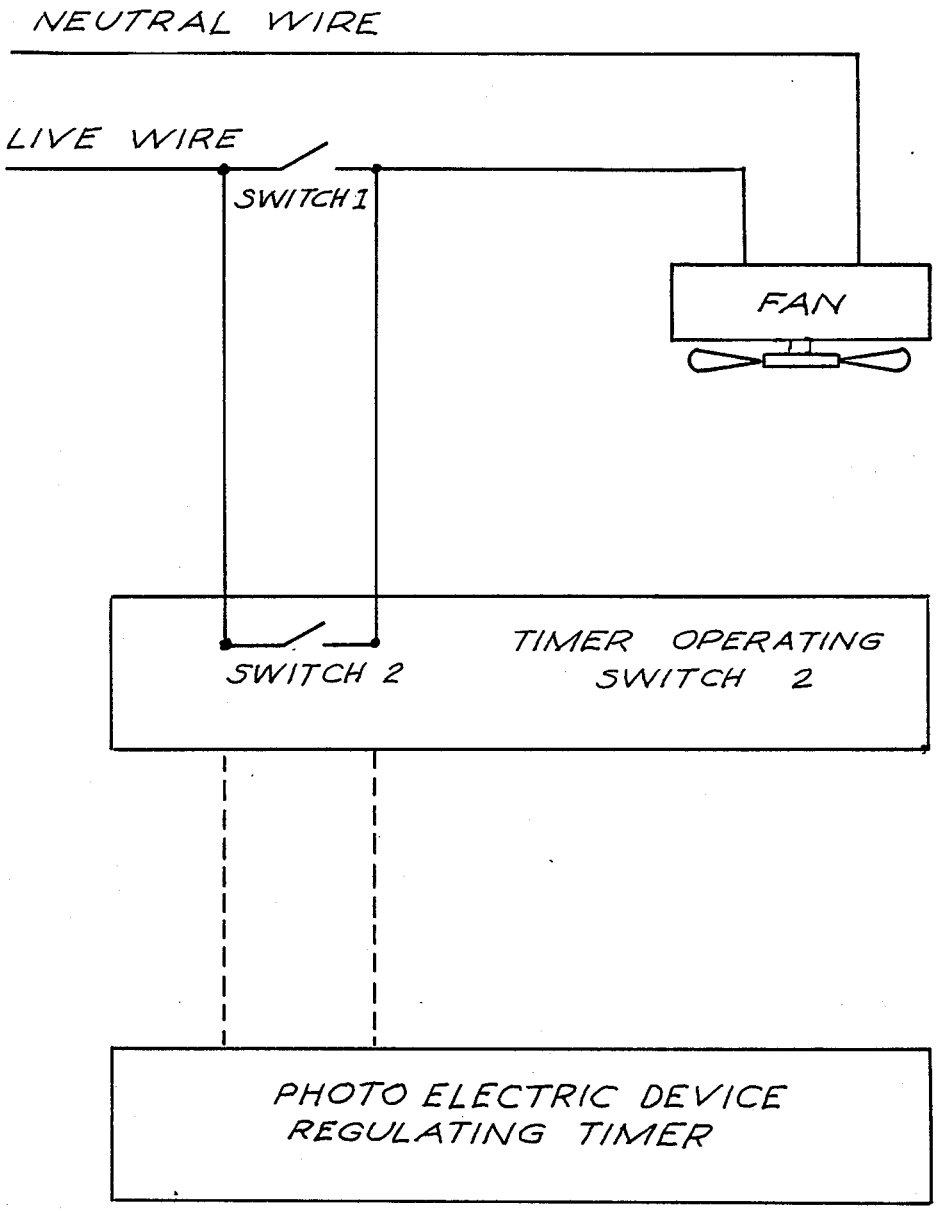

The earth is heated by the sun, and cools when the sun is obscured at night. Air at dawn is approximately 20° F. cooler than air at noon. It most nearly approaches the air conditioned interior house temperature at dawn in summer, this is the best time of day to ventilate the house by exchanging interior air for exterior air.

Fans are actuated at dawn by the light increase acting on a photo electric device which causes closure of a relay switch in the power line to a fan. A timing device switches off the relay switch after a suitable period such as, for example, one hour. The relay switch in the power line may be placed across an existing switch enabling use of fans already installed for other purposes.

Most existing homes already have several fans. These are in clothes drying devices, cooker hoods and bathrooms. It does not matter for the method of the invention whether the fan exhausts air from the house or pulls air into the house. Existing fans are as effective and cheaper to use than fans specially installed for ventilation, since all ducts needed are already in place. Either existing or new fans can be utilised.

BACKGROUND MATERIAL RELEVANT TO THE DISCLOSURE

The average bathroom fan moves about 200 cubic feet of air per minute. Cooker hood fans range from 150 cfm to 300 cfm and clothes dryer fans have higher capacities. The volume of air in a house with 8 ft. ceilings and 2,000 square feet of area is 16,000. cubic feet. A 200 cfm fan would change the air in 80 minutes. If several fans were used the house could receive several complete air changes by running the fans for 1 hour after dawn, before the sun has caused any significant temperature rise.

Photo electric devices fall into two classes. Photo transistors which need a power source and Photo cells which generate electric current when light falls upon them. Either can be used but use of the Photocell type may simplify wiring problems if a fan switch is on the live wire and the neutral is not adjacent. It is well within the known art to use a photo electric device to switch a current on or off. Timers are available which can have a variable response and which can be designed to operate a switch after a variable preset time. These devices are very well known and are not part of the invention except as means of carrying out the method of the invention.

DESCRIPTION OF THE INVENTION

The methods of the invention may be illustrated by reference to a domestic bathroom which has a manual switch on the wall controlling an exhaust fan in the ceiling, which, when running, vents air outside the house living space. The wall switch will open and close contacts on the live wire carrying current to the fan motor. It will normally be open and the fan stopped. Across these switch terminals is connected a second switch herein called switch 2. Use of switch 1, the original switch, is not affected. Switch 2 is operated by the timing device which in turn is regulated by the photo electric device.

In the middle of the night switches 1 and 2 are open and the fan stopped. At dawn light through the bathroom window activates the photo electric device. If the bathroom has no window the photo electric device must be placed where it is exposed to daylight. On activation, the photo electric device starts the timing device which closes switch 2 starting the fan and also starting a variable timing system. The fan commences running so venting air outside the house and pulling air into the house through cracks, leaks, open windows, chimneys etc. other fan ducts etc. The fan continues to replace inside air with outside air until the preset duration of operation causes the timer to operate to open the switch again; and stop the fan.

The timer is constructed so that it will not reset so long as it continues to receive a signal from the photo electric device that light is present. When no light reaches the photo electric device the timer resets itself ready for the next dawn.

Thus, if the bathroom light is put on during the night the photo electric device would cause the timer to close switch 2 and the fan to run, but the fan would stop and the timer reset when the bathroom light was switched off. The timing device and the photo electric device may be separate pieces connected by wiring and may be placed in any convenient site. Since the receipt of light by the photo electric device inhibits the resetting of the timing device, the fan will not start during daylight hours unless switch 1 is closed manually.

The timing device should best be designed to allow the timing delay between starting the fan and switching off the fan to be varied from zero to 2 hours from its initiation by the photo electric device. There are three important reasons for this.

First there may be times of seasonal change when the fan is not required to run. If the timer is set to zero time, then the cycle of switching is fast and, in effect, the fan does not run. This thus provides a means of shutting off the ventilation system.

Secondly there will be days when the outside temperature is not sufficiently different as to require much air change. In this case the timer may give best advantage in running for 20–30 minutes. At other times the fans may advantageously run for 2 hours to cool down the house effecting more air changes than needed for simple ventilation. For example, if the house can be cooled down 10° F. each morning by use of outside dawn air the load on the airconditioning system may be substantially reduced by good insulation without sacrificing ventilation.

Thirdly there is a need for some ventilation in the winter. the air outside will be cold. If the fan or fans operate at dawn for a short period then ventilation will be achieved without the house occupants being aware of it. They will be in bed and by the time they awaken the house heating system will have restored normal temperature.

The invention is illustrated using a bathroom fan. However similar use may be made of other domestic devices containing fans. The timer may be wired across the switches of a clother dryer so that the fan of the dryer operates to the dictate of the photo electric unit and timer. The method of the invention may also be used to operate the fan in a cook top hood.

It should be noted that the method of the invention when used with exhaust bathroom fans does not cool down the bathroom only. The entering air will be dispersed throughout the house depending on where the air finds entry. Further the fan involved may be located in a hotel bathroom or an office rest room.

A suggested arrangement is that the timer and relay switch be a single unit which may be placed inside each appliance. The photo electric device may also be a separate unit, weather proofed for inside or outside location, and having a low voltage output signal to the timer. This ensures that the wiring outside the appliances is of low voltage and safe.

Two further examples of the advantages of the method of the invention in improving living space comfort is shown by considering cooking in an oven in hot weather. It is onerous to utilise an oven for long cooking dishes since the kitchen becomes hot. Most ovens have a timing device which can switch the oven on and off. If the cooking hood has a fan equipped with the invention the kitchen will be ventilated at dawn. If the oven is timed to cook before dawn, the occupants of the house will have a cool kitchen in the morning despite the cooking operation and with reduced load on the air conditioning.

The second example would be to run a dishwasher with time delayed start so that the drying cycle was complete just before dawn and the cooker hood fan vented this heat from the kitchen just after dawn, using the methods of the invention.

The advantage of the methods of the invention may be summarised in the phrase "bring that beautiful cool summer morning into your home".

We claim:

1. A method of ventilating living space with the coolest outside air obtainable in the 24 hour daily cycle by utilizing a photoelectric device to provide a signal when the outside light is increasing at dawn, at which time the outside air is at its coolest, and using this signal to actuate electrical contacts which start operating an air moving device propelling air into or out of the living space so as to exchange inside air with outside air thus effecting ventilation of the

2. The method of claim 1 wherein the photoelectric device signal actuates a timing device which then starts the air moving device operating, thus starting ventilation of the living space, and which timing device, after a predetermined time, further actuates electrical contacts inhibiting the operation of the air moving device thus stopping the ventilation of the living space.

3. The method of claim 1 wherein the air moving device is a bathroom ventilating fan.

4. The method of claim 1 wherein the air moving device is part of a cooking equipment hood.

5. The method of claim 1 wherein the air moving device is part of a clothes drying machine.

* * * * *